US005278550A

United States Patent [19]

Rhein-Knudsen et al.

[11] Patent Number: 5,278,550

[45] Date of Patent: Jan. 11, 1994

[54] APPARATUS AND METHOD FOR RETRIEVING AND/OR COMMUNICATING WITH DOWNHOLE EQUIPMENT

[75] Inventors: Erik Rhein-Knudsen, Missouri City; Mark A. Fredette, Houston, both of Tex.

[73] Assignee: Schlumberger Technology Corporation, Houston, Tex.

[21] Appl. No.: 820,724

[22] Filed: Jan. 14, 1992

[51] Int. Cl.[5] ..... G01V 1/00

[52] U.S. Cl. ..... 340/855.1; 340/854.8; 250/254; 175/40

[58] Field of Search ..... 340/854.9, 855.1, 854.8; 250/254, 256; 166/65.1, 98; 175/40

[56] References Cited

U.S. PATENT DOCUMENTS

| | | | |
|---|---|---|---|
| 3,209,323 | 9/1965 | Grossman, Jr. | 340/854.8 |
| 4,121,657 | 10/1978 | McClure | 166/66 |
| 4,790,380 | 12/1988 | Ireland et al. | 175/50 |
| 4,806,928 | 2/1989 | Veneruso | 340/854.8 |
| 4,814,609 | 3/1989 | Wraight et al. | 250/254 |
| 4,845,359 | 7/1989 | Wraight | 250/254 |
| 4,856,582 | 3/1989 | Smith et al. | 166/98 |
| 5,008,664 | 4/1991 | More et al. | 175/40 |
| 5,017,778 | 5/1991 | Wraight | 250/254 |
| 5,107,939 | 4/1992 | Lenhart et al. | 175/61 |

*Primary Examiner*—J. Woodrow Eldred
*Attorney, Agent, or Firm*—Gary L. Bush; Wayne I. Kanak; John J. Ryberg

[57] ABSTRACT

Method and apparatus for fishing for and/or communicating with subsurface apparatus. In a preferred embodiment, a subsurface logging-while-drilling (LWD) or measuring-while-drilling (MWD) apparatus is placed in tandem with a drill string near the bottom of a borehole. The LWD apparatus includes a surface retrievable component such as a nuclear source carrier with a fishing head facing upwardly. The carrier is releasably secured within the LWD apparatus with means such as a shear pin. A wireline conveyed tool having a downwardly facing latching mechanism includes a downhole powered latch for telescopically extending beyond the fishing head, forcing a latching lug radially inwardly below the fishing head, and moving axially upward to latch the fishing head. Further upward latch movement causes the fishing head to move upwardly until the shear pin shears which releases the carrier from the subsurface apparatus. The wireline tool with the attached carrier is then brought to surface with the wireline cable. In a preferred embodiment, the subsurface apparatus includes a secondary coil within its tubular housing. A primary coil is provided on the wireline tool such that upon the wireline tool landing within the subsurface apparatus, the primary coil is nested within the secondary coil. As a result, a bi-directional communication link is established from surface instrumentation to the subsurface apparatus via the wireline cable and the nested coils.

14 Claims, 6 Drawing Sheets

APPARATUS AND METHOD FOR RETRIEVING AND/OR COMMUNICATING WITH DOWNHOLE EQUIPMENT

TECHNICAL FIELD

The present invention relates generally to apparatus for removing downhole equipment from a borehole such as a retrievable part of a logging-while-drilling tool. The present invention also relates to apparatus for establishing a communication link to downhole equipment. In a preferred embodiment, the invention relates to a wireline method and apparatus for powered latching onto a retrievable radiation source carrier and removal thereof from a logging-while-drilling tool disposed downhole in a drill string.

BACKGROUND OF THE INVENTION

Commonly-assigned U.S. Pat. No. 4,814,609 to Wraight et al., which issued Mar. 21, 1989 and is incorporated herein by reference, describes a logging-while-drilling (LWD) tool for performing radiation-based measurements of formation density and porosity while a borehole is being drilled. The LWD tool generally includes a tubular body adapted for tandem placement in the drill string. The tubular body is provided with an upwardly opening passage and an interior chamber for accommodating the insertion and removal of a carrier containing one or more energy radiating sources. The carrier is loaded and unloaded into the LWD tool at surface with shielding equipment and in a manner that is described in detail in commonly-assigned U.S. Pat. No. 4,845,359 to Wraight, which issued Jul. 4, 1989 and is hereby incorporated herein by reference.

The carrier is provided with a fishing head at its upper end that extends upwardly into the tubular body's upwardly opening passage. Such fishing head is provided so that in the event the LWD tool should become stuck in the borehole, the carrier can be retrieved with a fishing tool deployed from the surface via a cable, down the flow path of the drill string, and into the LWD tool's upwardly opening passage. Once the fishing tool has grasped the fishing head, the cable is pulled on from surface with sufficient force to cause a retaining pin to shear off and allow the carrier to be freed from the LWD tool and brought to surface. A conventional fishing grapple such as that available from Otis Engineering Company of Dallas, Tex. has been used for this purpose.

It has been found that under certain adverse drilling conditions, retrieving the radiation source carrier from the LWD tool while it is downhole by using a conventional fishing tool can be difficult. For example, in a highly deviated well, the force applied at the surface might only be partially transferred to the carrier because of significant contact and associated friction between the cable and the interior of the drill string, and this amount of force remaining at the carrier's fishing head may not be enough to shear the retaining pin. Also, in very deep wells, because of the weight of the cable itself and because only a limited amount of force can be applied to the cable to begin with before it might break at the surface, the amount of force actually applied to the carrier's fishing head again might not be enough to shear the retaining pin. In such instances, wireline jars must be employed to free the carrier from the LWD tool. However, use of such jars may damage the carrier or separate the fishing head from the carrier, making it then difficult or impossible to grasp the fishing head and bring the carrier to the surface.

Another problem with prior art methods and apparatus for fishing for a downhole tool is that there is insufficient information at the well surface available to the operator concerning the progress and status of the carrier extraction process. In addition, there is lack of timely confirmation of when or if the extraction process has been successful.

Another feature of the LWD tool described in U.S. Pat. No. 4,814,609 is that it may operate either in a recorder or "real-time" mode, or both. The recorder mode is accomplished with an on-board recorder for recording the LWD measurements downhole for later retrieval or "down-loading" when the tool is returned to the surface. The real time mode is accomplished with a mud-pulse telemetry system that transmits the measurement information to the surface via sonic pulses created in the drilling fluid. In some instances, sufficient but sparse data are telemetered to the surface in real-time mode because of the limited bandwidth of the mud transmission medium. The term "sparse" is used here to mean that not all measured data is typically transmitted to the surface. For example, high density data is not routinely transmitted to the surface via the mud flow path, but is recorded on the on-board recorder. Unfortunately, if the LWD tool should become permanently stuck in the borehole and must be abandoned, the data recorded downhole is also lost forever.

In light of the prior art problems described above, it is a primary object of this invention to provide a method and apparatus for removing downhole apparatus from an LWD tool while downhole with improved controllability and observability characteristics.

Another object of the invention is to provide a downhole fishing apparatus that is capable of applying its own extracting force directly to the downhole apparatus to be retrieved, such as a carrier for radiation sources in a logging-while-drilling tool, for the purpose of releasably extracting it from securement to the LWD tool.

A further object of the invention is to provide a downhole fishing apparatus with a bi-directional communication link to a downhole LWD tool via a wireline cable for the purpose of controlling the operation of the LWD tool from surface and for retrieving recorded information.

Yet another object of the invention is to provide a downhole fishing apparatus with a bi-directional communication link to a downhole LWD tool for the purpose of monitoring the progress and status of the downhole extraction process being conducted by the fishing apparatus.

SUMMARY OF THE INVENTION

The objects identified above as well as other advantages and features of the invention are provided in a wireline tool adapted for deployment in a well bore and for landing within an LWD tool having a retrievable carrier inside where the carrier is equipped with an upwardly-projecting fishing head. According to the invention, the wireline tool includes a downwardly-facing, electrically-powered latch mechanism for selectively connecting the wireline tool to the fishing head. The powered latch aspect of the invention includes a motor connected to a gear reduction unit which drives a threaded rod. A shroud threaded on the rod moves axially with rotation of the rod by the motor/gear reduction unit. Collet fingers carried by the shroud and the shroud itself include mechanisms which radially open the fingers when the shroud is driven to a lower axial position. When the shroud is moved upwardly, a lug on the lower end of each collet finger moves radially inwardly to a position beneath a downward facing shoulder of the fishing head. With further upward axial movement of the shroud, the collet finger lugs engage the fishing head. With still further axial movement, the collet finger lugs pull the fishing head and the attached radiation carrier upwardly without mechanical pulling force being exerted from the surface. The radiation source carrier is secured to the LWD tool by means of a shear pin. The wireline tool provides sufficient upward force on the fishing head to shear the shear pin, thereby freeing the carrier from the LWD tool for removal up the drill string flow path by means of the wireline being brought to the surface.

In a preferred embodiment, the invention also includes sensing apparatus for determining the axial position of the latch mechanism. This axial position measurement is transmitted to the surface instrumentation to provide the operator with an indication of the progress and status of the extraction process. Furthermore, measurement of motor current made downhole is transmitted to the surface instrumentation as an indication of shaft torque used in the extraction procedure of the invention, which is proportional to the force applied to the carrier's fishing head.

In a particularly preferred embodiment, the LWD tool and the wireline tool are each equipped with cooperatively arranged coils so that when the wireline tool is landed and properly seated within the LWD tool, the respective coils become nested and form a transformer. The transformer provides a bi-directional communication link between surface instrumentation and the LWD tool for communicating information from downhole to surface such as logging data that was recorded and stored downhole in the LWD tool, and for communicating information from surface to downhole such as a new or different set of measuring and recording tool parameters.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which.

DETAILED DESCRIPTION OF THE INVENTION

Overview of preferred embodiment

Figure 1:
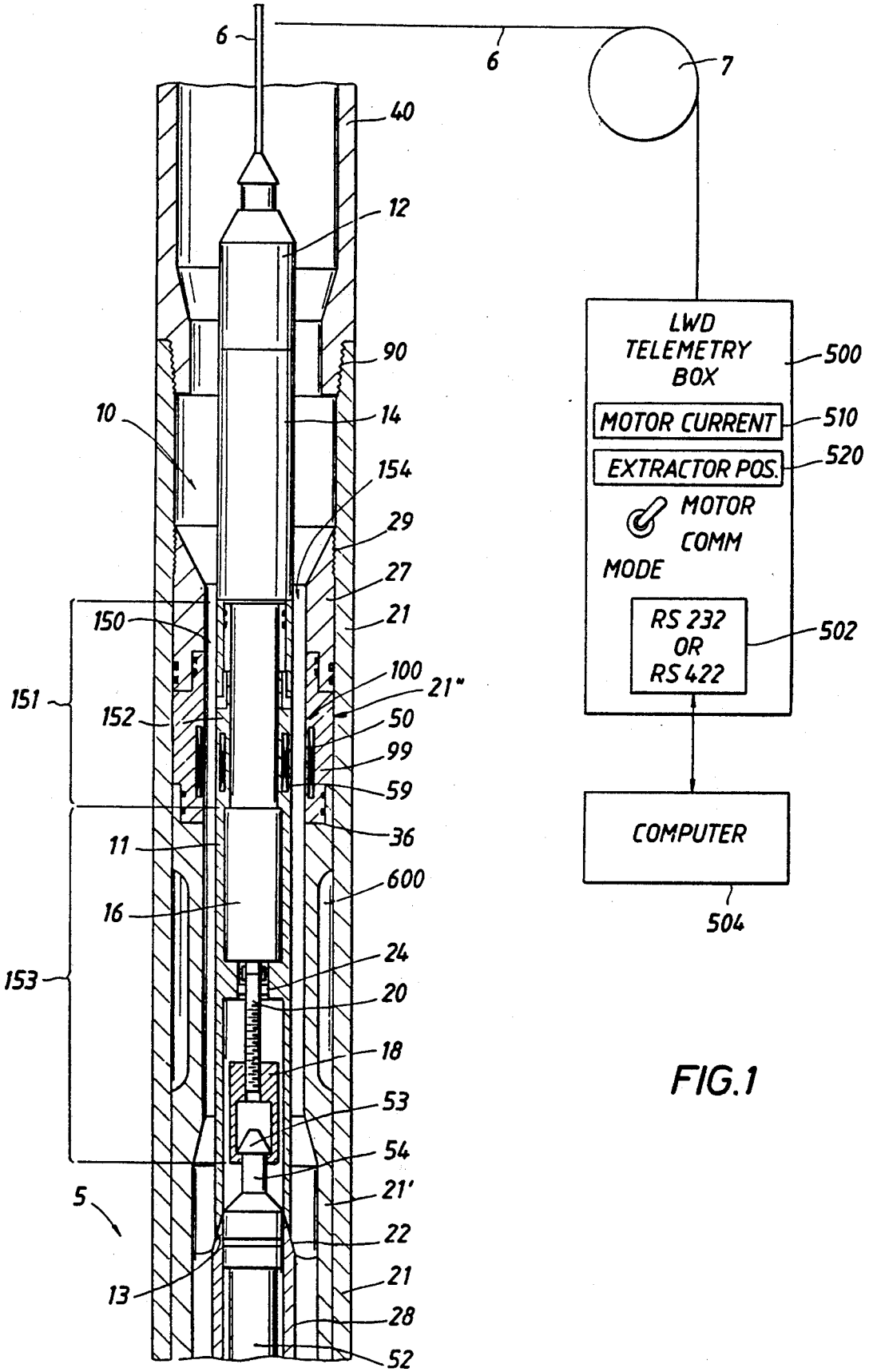
FIG. 1 is a schematic illustration of a wireline extraction and communication tool landed in a downhole logging- while-drilling (LWD) tool having a radiation source carrier which is to be removed from such LWD tool and further illustrates surface instrumentation for controlling the extraction of the carrier and/or providing bi-directional communication between such surface instrumentation and the LWD tool.

FIG. 1 illustrates a preferred embodiment of the invention in schematic form. FIG. 1 also illustrates a logging-while-drilling (LWD) tool 5 with which the present invention has particular utility, such as that generally illustrated in U.S. Pat. No. 4,814,609 to Wraight as described above. Briefly, LWD tool 5 is shown tandemly placed in a drill string of drill pipes and drill collars 40. LWD tool 5 includes an elongated mandrel 52 releasably secured within an elongated cylindrical body 28, which is secured within outer housing 21. Such mandrel 52 is part of a radiation source carrier assembly. A fishing head 53 extends upwardly from mandrel 52. The mandrel 52 and the upwardly extending fishing head 53 are secured to cylindrical body 28 by a shear pin 19 seen in detail FIG. 2C.

LWD tool 5 includes an outer housing 21 having female threads 90 disposed and its upper end to which male threads of an upper section 40 of a drill string may be attached. An inner housing 21' is disposed within outer housing 21. Annular spaces 600 between inner housing 21' and outer housing 21 are provided for placement of radiation detectors (not shown) of the LWD tool 5.

In an embodiment of LWD tool 5 that has been modified according to one feature of the present invention, tool 5 includes a communication linkage module 21'' disposed on top of inner housing 21'. A jam nut 27 is threaded inside outer housing 21 at threads 29 so as to capture communication linkage module 21'' between jam nut 27 and the top of inner housing 21'. Inner housing 21' shoulders against outer housing 21 at a lower position (not shown).

The invention also includes a cooperatively dimensioned wireline-conveyed tool 10 that functions as an extractor and communication coupler. Wireline tool 10 includes a tubular housing 11 with downwardly facing annular surface 13 adapted to land on an upwardly facing surface 22 of cylindrical body 28 which secures fishing head 53 and elongated mandrel 52 in the LWD tool 5. In other words, tool 10 is dimensioned to pass through cylindrical flow path space 154 within the jam nut 27, communication linkage module 21'' and inner housing 21' as tool 10 is lowered by wireline 6 through drill string 40 from the surface of the well.

The tool 10 includes a cable connector module 12 having electrical leads connected to the leads of the wireline cable 6. An electronic cartridge 14 is provided and performs three primary functions. The first function is to provide an interface between wireline surface instrumentation 500 and a communication bus in the LWD tool 5. The second function is to control the extraction of the radiation source assembly of mandrel 52 based on surface commands. The third function is to process and telemeter the status of the extraction procedure to the surface.

Tool 10 includes a latching and communication adapter 150 which preferably includes a communication module 151 and a latching module 153. An alternative embodiment of the invention, where latching is not desired, includes only the communication module 151 cooperatively arranged with communication linkage module 21" of the downhole LWD tool 5 to establish magnetic field data coupling 100.

Communication module 151 includes a hollow mandrel 152 about which a coil 59 is wound. The tool 10 is dimensioned such that when it is landed on downhole LWD tool 5, the inner coil 59 is nested within outer coil 50 of communication linkage module 21" thereby establishing a magnetic field data coupling for bi-directional electrical communication from surface instrumentation 500 to downhole LWD tool 5.

Latching module 153 includes a motor 16 with an associated gear reducer the output of which is a lead screw 20 (threaded shaft) which rotates within a rotary pressure seal 24. A fishing head overshot 18 is threaded about lead screw 20 and, as described in detail below, moves axially with rotation of the lead screw 20. Overshot 18 includes a releasable, unidirectional latching mechanism that will pass by fishing head 53 when moved downward. When overshot 18 is moved upward, the latching mechanism will firmly grasp fishing head 53. Further upward movement of overshot 18 dislodges fishing head 53 and attached elongated mandrel 52 from securement to elongated cylindrical body 28 of downhole LWD tool 5.

The surface instrumentation 500 schematically illustrated in FIG. 1 includes an telemetry interface and display system. Such system preferably includes displays 510, 520 of motor current and position of fishing head overshot 18. It includes a switch and circuitry for controlling the mode of the tool as to the latching function or the communication function. The communicated data from LWD tool 5 to surface instrumentation is not normally displayed on surface instrumentation 500, but is passed directly to computer 504 via serial link 502. The surface instrumentation 500 also provides electrical power to tool 10 via wireline 6.

DETAILED DESCRIPTION OF TOOL EXTRACTOR AND COMMUNICATION COUPLER

1. Communication Coupler

Figure 2A:
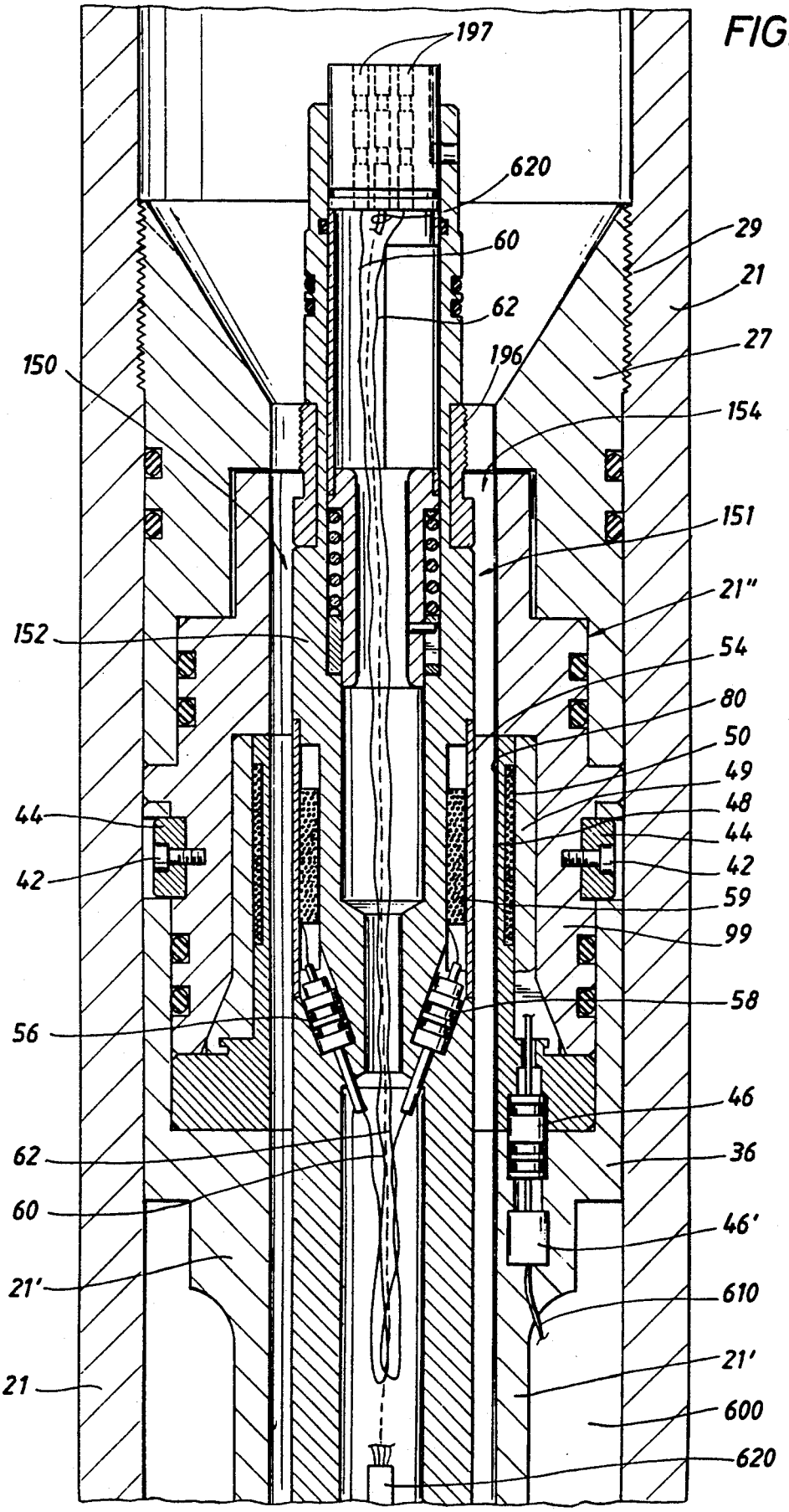
FIGS. 2A, 2B and 2C illustrate in cross-section a preferred embodiment of a downhole LWD tool and a wireline extraction and communication tool landed within and on the LWD tool prior to extraction of a carrier for radiation sources in such LWD tool.
Figure 2B:
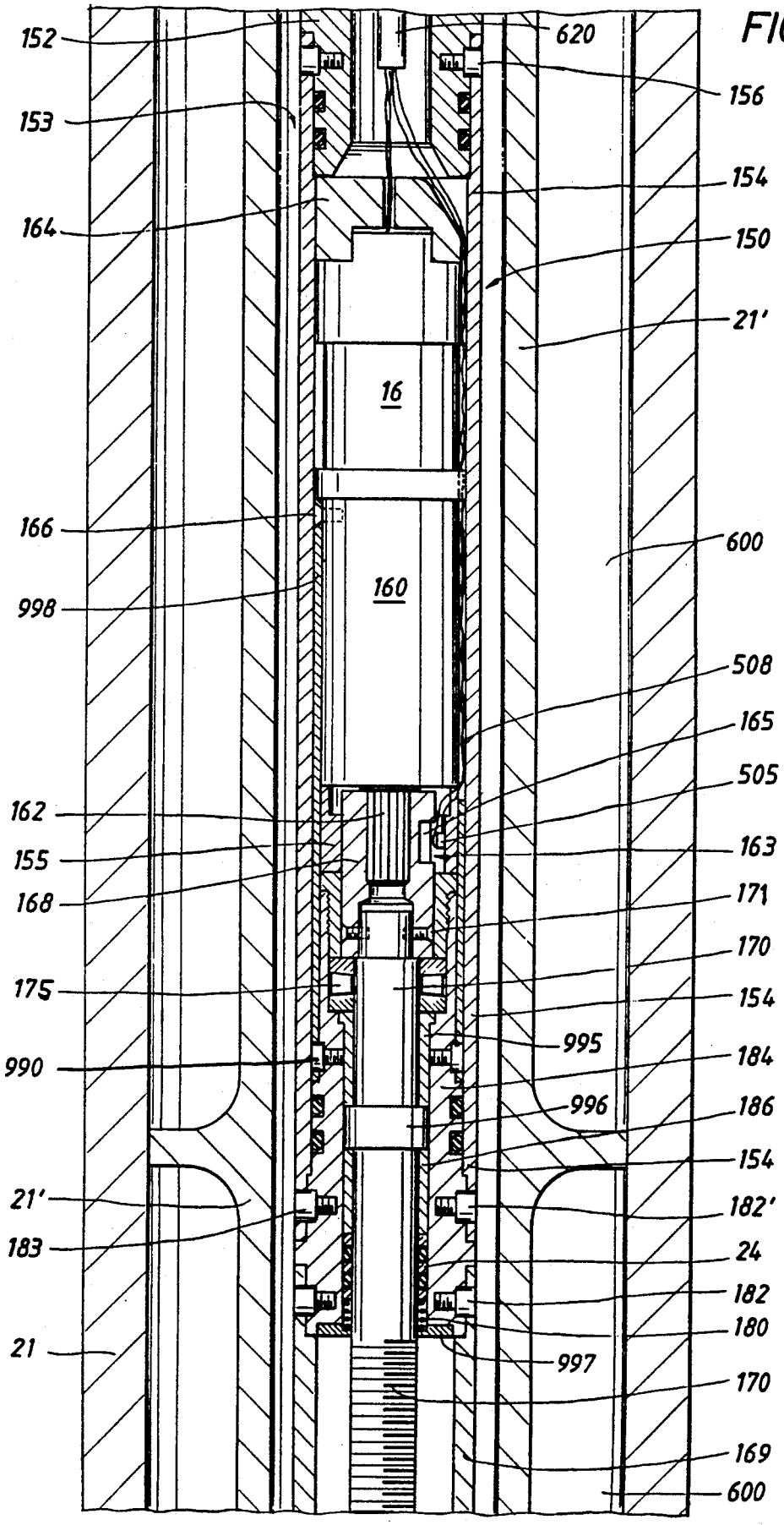

FIG. 2A is a cross-section of the communication module 151 of wireline tool 10 and communication linkage module 21" of apparatus 5. The top of communication module 151 is connected to telemetry cartridge 14 as indicated in FIG. 1. The bottom of communication module 151 is connected to the latching module 153 as illustrated in FIGS. 1 and 2B.

The LWD tool 5 as illustrated in FIG. 1 includes inner housing 21" which has an increased diameter section 36 disposed at its top. The housing 99 of communication linkage module 21" is secured to increased diameter section 36 by means of bolts 42 with washers 44 placed between bolts 42 and housing 99. Jam nut 27 threaded to outer housing 21 by threads 29 traps inner housing 21" and module 21" within housing 21 by forcing a lower shoulder (not shown) of inner housing 21" against a corresponding shoulder (not shown) of housing 21.

Housing 99 of module 21" includes a tube 49 having an inner cylindrical surface 80 of the same inner diameter as inner housing 21'. Tube 49 is preferably fabricated of titanium and includes outer coil 50 disposed in an annular recess preferably packed with an elastomeric material. A thin layer 48 of titanium forms the surface of tube 49 between coils 50 and 59. The upper part of housing 99, the tube 49, and inner housing 21' all have the same inside diameter in order to limit disturbance of drilling fluid flow and its erosion effects on the inside of the LWD tool 5.

Coil 50 has a lead pair (not shown) which runs to pressure feed-through 46 in the walls of tube 49 and increased diameter section 36 of the inner housing 21" of the LWD tool. Such feed-through 46 mates with a plug 46' disposed in section 36. Electrical leads 610 run from plug 46' through annular spaces 600 to an electronic module of downhole LWD tool 5 (not shown).

The communication module 151 of tool 10 includes a hollow mandrel 152 having an upper mandrel extension with threads 196 for securement to a housing of telemetry cartridge 14. Connectors 197 are shown in phantom which connect leads 60 and 62 from the inside of mandrel 152 to the telemetry cartridge 14. Three connectors 197 are illustrated, but nine are necessary to provide electrical communication and power transfer between telemetry cartridge 14 and the latching and communication adapter 150. A cable 620, which includes five leads, runs from five of the connectors 197 shown at the top of FIG. 2A through the interior of mandrel 152 to motor 16 and sensor 505 below (FIG. 2B).

Inner coils, one transmitter and one receiver, are indicated by reference number 59. They are covered by a thin elastomeric sleeve 54 placed in an external annular space in the wall of mandrel 152. Such coils 59 are dimensioned to be nested within outer coil 50 when wireline tool 10 is landed on landing surface 22 (see FIG. 1). Four pressure feed through (two of which are shown by reference numbers 56, 58) provide a pressure protected path from coils 59 to leads 60, 62 (and two more, not shown). Such leads pass along central passages of mandrel 152 from connectors 197 to the ends of feed through 56, 58.

2. Extraction module

As illustrated in FIG. 2B, housing 154 for the latching module 153 is secured to mandrel 152 of the communication module 151 by bolts 156. Motor 16, e.g. a series wound d.c. motor, and gear reducer 160 are disposed within housing 154. Gear reducer 160 preferably provides a gear reduction of 941:1 from the output of motor 16 such that output shaft 162 of gear reducer 160 is driven at slow speed, but with high torque. Both motor 16 and gear reducer 160 are available from Globe Motors of Preston, Ohio. The motor 16 and gear reducer 160 assembly are secured within housing 154 by inner housing 998 being secured to gear reducer 160 by means of screws 166, by inner housing 998 being secured to shaft housing block 184 by means of screws 990, and by shaft housing block 184 being secured to housing 154 by means of screws 183. Splined gear reducer output shaft 162 is mated to coupling 168, which is pinned to the upper end of shaft 170 by means of pins 171. The splines in coupling 168 allow shaft 170 to move a small distance with respect to motor output shaft 162. In concert with the bearing support for shaft 170 discussed further below, this arrangement allows shaft 162 to transmit torque to shaft 170, but prevents shaft 170 transmitting axial force to shaft 162.

A notch 163 in coupling 168 includes a magnet 165. Such magnet 165 is in axial alignment with magnetic sensor 505 secured in the wall of sensor mount 155 and facing radially inward. As the coupling 168 turns and magnet 165 passes sensor 505, a pulse is generated in sensor 505 and sent via three leads 508 (only two are shown) of cable 620 and ultimately to cartridge 14. The cartridge electronics processes each pulse determining the absolute extraction position and telemeters such information to the surface instrumentation 500. The absolute extraction position is presented on monitor 520 at the surface as an indication of the extraction progress. The current applied to the motor 16 may also be measured in cartridge 14 and telemetered to the surface as an indication of the torque being applied to shaft 170 during the extraction process. Schematic monitors of such extraction position and current are illustrated in FIG. 1 by reference numbers 520, 510.

As stated above, a shaft housing block 184 is secured to housing 154 by means of screws 183. A bushing 186 and spring retainer 997 capture a pressure seal 24 which excludes drilling fluid from parts internal to housing 154, while allowing shaft 170 to rotate. The pressure seal includes two "O" rings, three teflon (trademark of Dupont Corporation) rings and a preload spring 180.

Bearing 175 is a bi-directional thrust roller bearing disposed near the top of shaft 170. Bearing 175 isolates axial forces on shaft 170 from motor 16 and gear reducer 160, and supports axial loading on shaft 170 while allowing it to rotate freely. Axial forces pushing shaft 170 upward (e.g. as caused by drilling fluid pressure trying to force shaft 170 upward) are transferred from the upper shoulder of increased diameter section 996 to upper bushing 995 to bearing 175 to shaft housing block 184. Downward force (e.g., as generated during an extraction operation) on shaft 170 is transferred through pins 171 to coupling 168 to bearing 175 to shaft housing block 184.

Figure 2C:
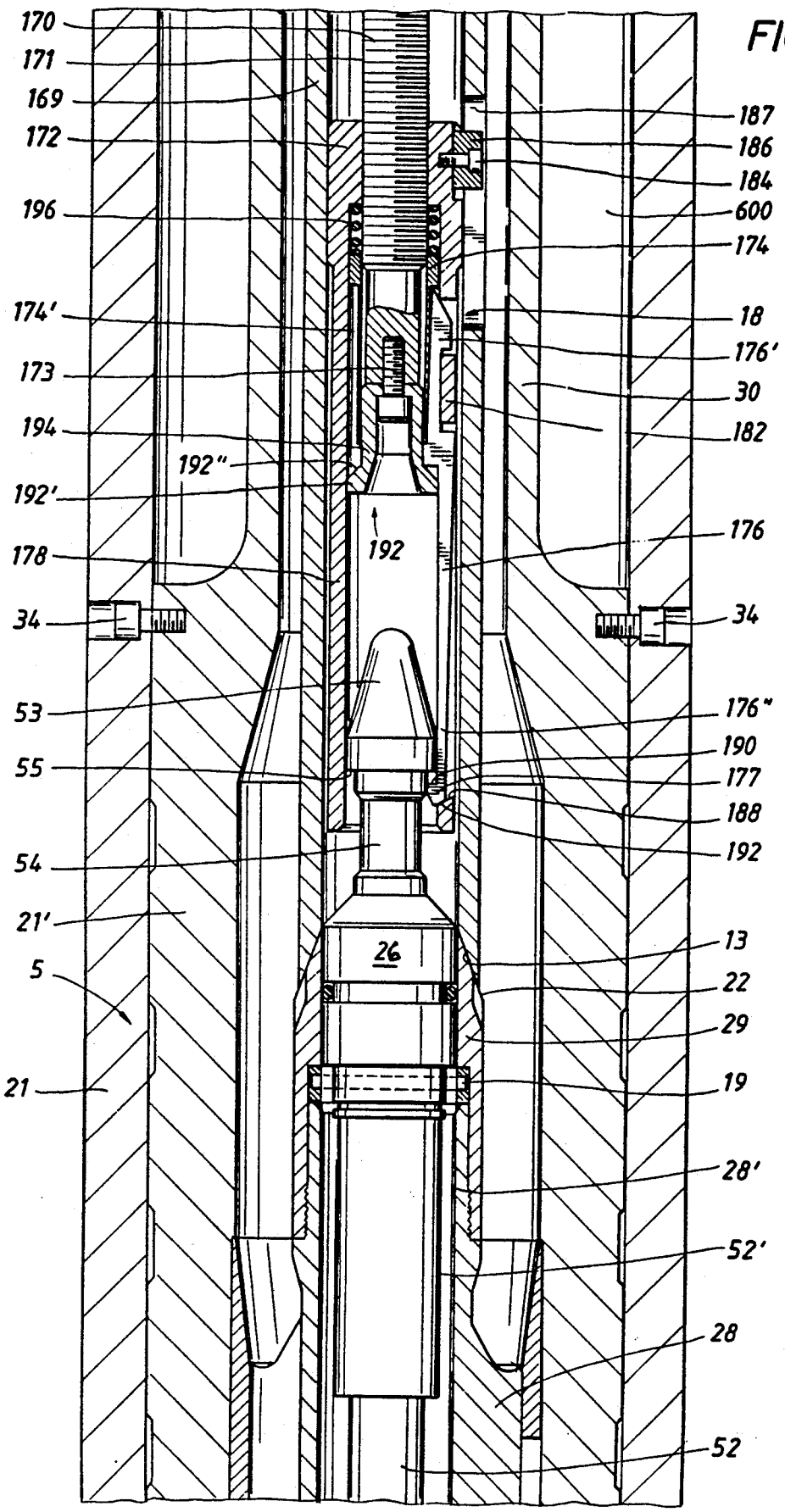

Lower housing 169 is connected to housing block 184 by screws 182. FIG. 2C shows that threaded shaft 170 extends downwardly within lower housing 169 which ultimately lands below with its downwardly facing annular landing surface 13 on upwardly facing landing surface 22 of source assembly jam nut 29 of cylindrical body 28. The upper end 172 of collet finger shroud 178 is threaded and screwed onto shaft 170. Upper end 172 of shroud 178 includes a key 186 secured in its wall by means of a screw 184. A keyway 187 within lower housing 169 restricts key 186 to axial motion whereby shroud 178 moves axially in response to rotation of threaded shaft 170.

The bottom of collet finger shroud 178 extends below the fishing head 53 which extends upwardly from mandrel 52 via coupler 26. The shroud 178 carries a plurality (preferably three equally angularly spaced) collet fingers 176, each having an upper head section 176' and a lower foot section 176" having a latching lug 177 placed at its lower end. Each collet finger 176 is carried within shroud 178 in a longitudinal slot.

Latching lug 177 includes an upwardly facing lip 190 adapted to fit shoulder 55 beneath fishing head 53. Lug 177 includes a bottom facing inclined surface 192 which mirrors an upward facing inclined surface 188 of the bottom of each slot of shroud 178.

A ring 174 with downward depending skirt 174' is placed about the lower portion of threaded shaft 170. An end cap 192 is secured in the end of threaded shaft 170 by means of screw 173. End cap 192 includes a cylindrical portion 194 and an increased diameter portion 192'. A coil spring 196 acts to force ring 174 downwardly until ring 174 is stopped by collet finger upper head section 176'. The operation of the latching mechanism illustrated in FIG. 2C and described structurally above is described in detail below.

Fishing head 53 and mandrel 52 of downhole tool 5 are coupled together by means of coupling member 26. A nuclear source for the LWD tool 5 is carried within increased diameter section such as upper increased diameter section 52'. A source assembly jam nut 29 having upper landing surface 22 provided thereon is threaded about a neck 28' of cylindrical body 28. A shear pin 19 secures coupling member 26 to neck 28' of body member 28. Accordingly, upward force to fishing head 53 must be applied of sufficient level to shear pin 19 and allow head 53 and mandrel 52 to be moved upwardly.

Operation Of Extraction Module

Figure 3:
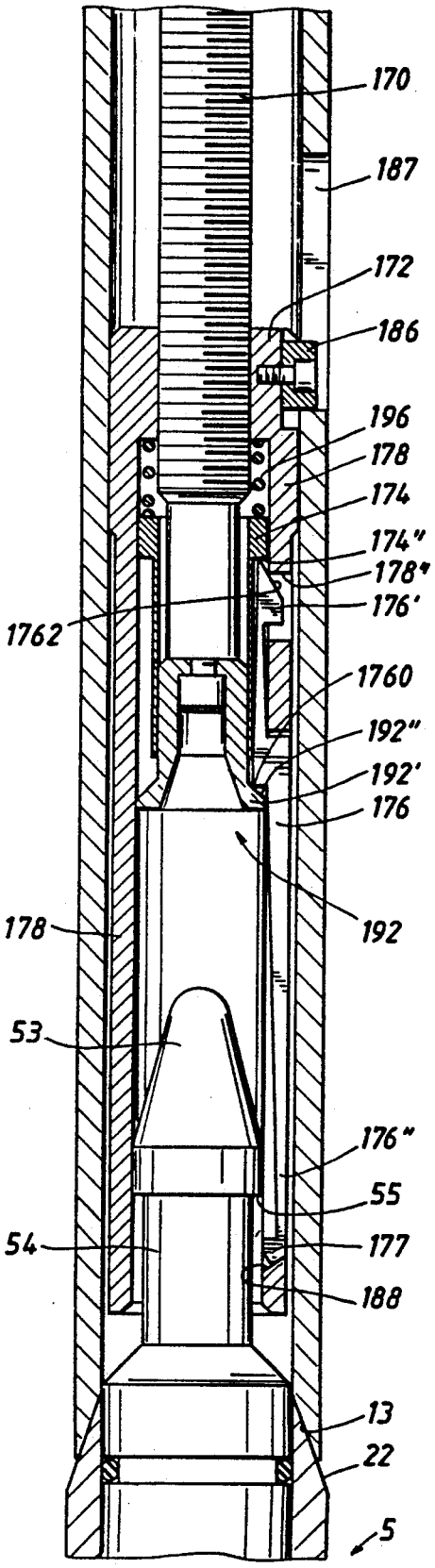
FIG. 3 illustrates the latching lug of a collet finger of the latching mechanism in the open position about the fishing head of the radiation source carrier with the shroud about the motor threaded shaft driven to its lowest position.
Figure 5:
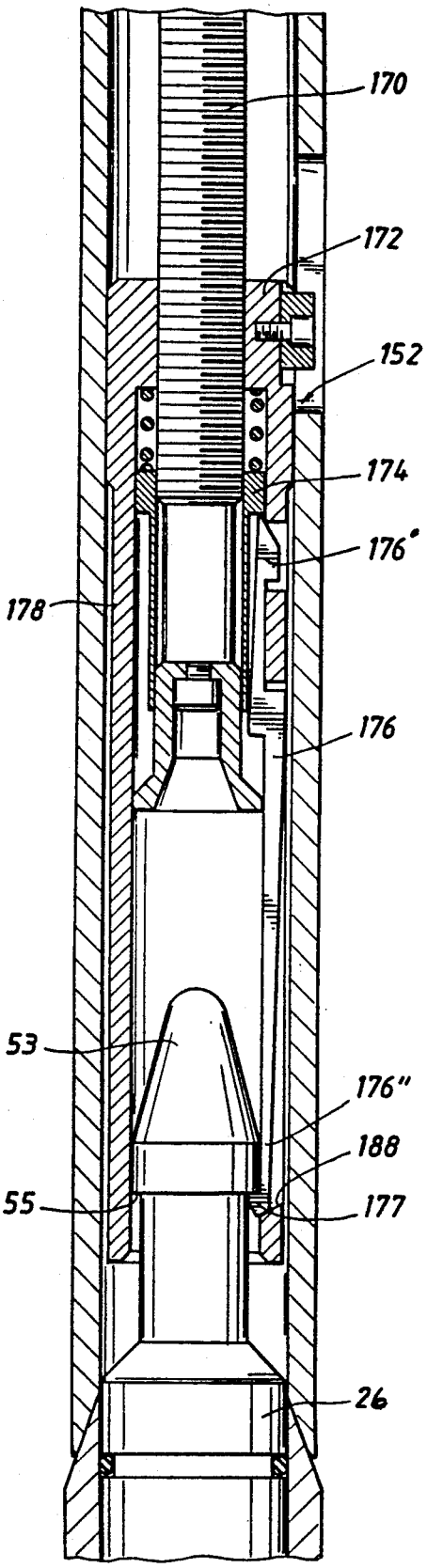
FIG. 5 illustrates the latching lug of a collet finger contacting a downwardly facing shoulder of the fishing head with the shroud about the motor threaded shaft driven upwardly from the position of FIG. 4.

FIGS. 3, 4, 5, and 6 are similar to the detailed illustration of the extraction module 153 of FIG. 2C, but depict such module in four different stages of operation. FIG. 3 illustrates the condition of the collet finger 176 in a retracted position where wireline tool 10 (tool extractor and communication coupler) has been inserted within the flow path 154 of the upper extending cylindrical portion of LWD tool 5. Annular landing surface 13 has landed on surface 22 of LWD tool 5. FIG. 3 further illustrates that collet finger shroud 178 has moved axially down to its bottom position by the rotation of threaded shaft 170 by motor 16/gear reducer 160. In this position, surface 192" of endcap 192 contacts point 1760 of collet finger 176 at the same time that lower edge 178" of shroud 178 contacts the inclined plane surface 1762 of collet finger 176. As a result, upper head section 176' moves radially inward as edge 178" moves down inclined plane surface 1762. The entire collet finger 176 rotates in a counter clockwise direction about the point 1760 on surface 192". Such motion causes collet finger lug 177 to ride upwardly and radially outwardly on surface 188. Such radial motion is sufficient to clear shoulder 55 of head 53 and enable extraction module 153 to be removed from LWD tool 5 without extracting head 53 and mandrel 52.

It is not necessary for the collet fingers 176 to be completely in the outer or retracted position for lug 177 to clear shoulder 55 when the tool 10 is being landed, however. With the lowering of tool 10, lug 177 may engage head 53 such that fingers 176 are forced radially outward. Once lug 177 is below shoulder 55, collet finger 176 returns to the position illustrated in FIG. 4.

Figure 4:
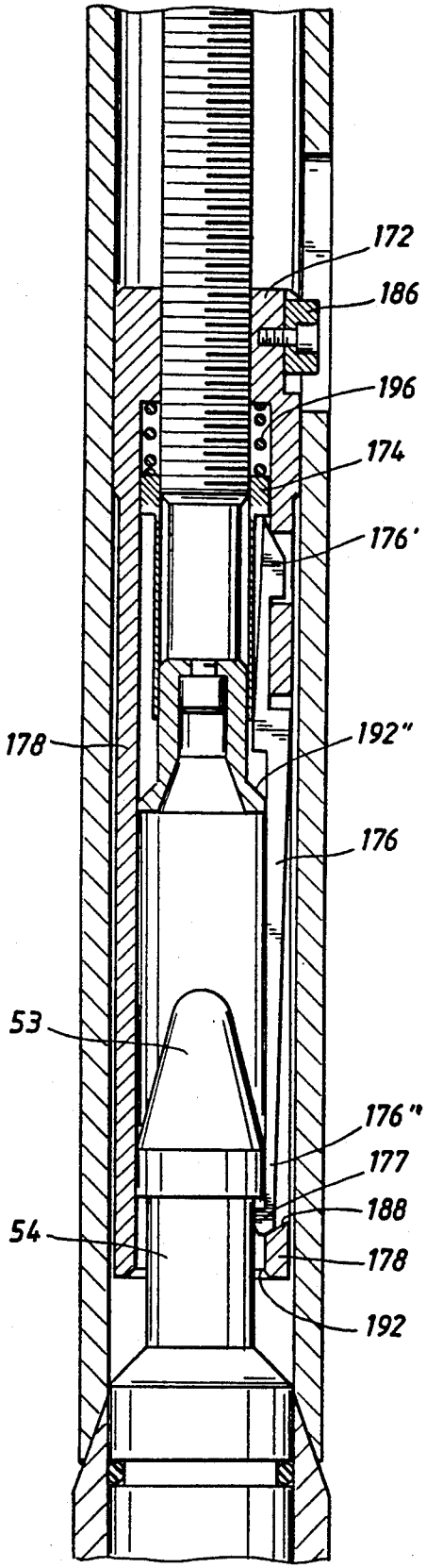
FIG. 4 illustrates the latching lug of the collet finger moved radially inwardly beneath the fishing head of the radiation source carrier with the shroud about the motor threaded shaft driven upwardly from its lowest position.

FIG. 4 illustrates the condition where collet shroud 178 has been moved axially upward. Now lug 177 is forced downwardly and radially inward along surface 188, because spring 196 through ring 174 pushes downwardly on the top of head 176' causing collet finger 176 to rotate clockwise as lug 177 is forced downwardly along inclined surface 188.

FIG. illustrates the latched position of latching module 153 whereby collet shroud 178 has been moved axially upward from the position of FIG. 4 such that lug 177 of finger 176 fully engages the downwardly facing shoulder 55 of fishing head 53. The lug 177 is captured between the inclined surface 188 of the bottom of shroud 178 and fishing head shoulder 55.

Figure 6:
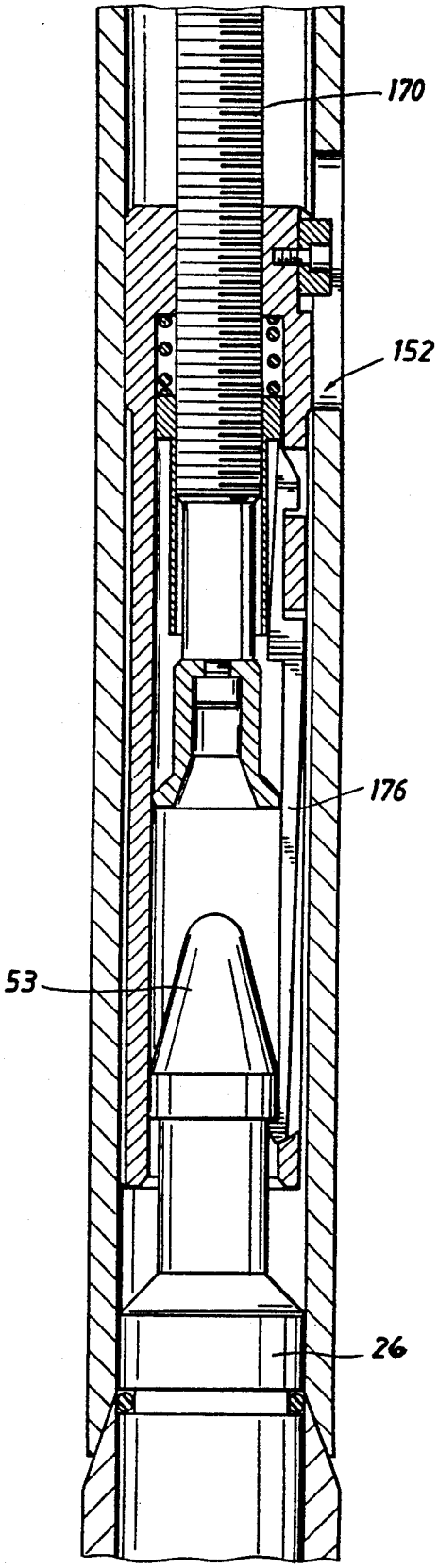
FIG. 6 illustrates the latching lug driven upwardly from the position of FIG. 5 thereby removing the fishing head and carrier attached thereto from the LWD tool.

FIG. 6 illustrates the condition of the latching module 153 where shaft 170 has continued to turn, under operator control from surface instrumentation 500, until shear pin 19 (FIG. 2C) has sheared and fishing head 53 and connected mandrel 52 (with nuclear sources) below have been dislodged from securement to downhole apparatus 5.

While a preferred embodiment of the present invention has been illustrated in detail, it is apparent that modifications and adaptations of the preferred embodiment will occur to those skilled in the art. However, it is to be expressly understood that such modifications and adaptations are intended to be within the spirit and scope of the present invention as set forth in the following claims.

What is claimed is:

1. Well bore apparatus for use in association with a subsurface apparatus disposed in a well bore, said subsurface having a sub-assembly releasably secured thereto, said sub-assembly having a fishing head extending upwardly therefrom, said well bore apparatus comprising:

a wireline tool adapted for placement in said well bore independently of said subsurface apparatus via a wireline cable connected to surface instrumentation, said wireline tool having a downwardly-facing, electrically-powered latch means for selectively connecting said wireline tool to said fishing head to said sub-assembly, said latch means including electrical-mechanical means for pulling said sub-assembly upwardly after said latch means has connected said wireline tool to said fishing head.

2. The well bore apparatus of claim 1 wherein said subsurface apparatus is an apparatus for measuring characteristics of earth formations surrounding said well bore, and wherein said well bore apparatus further comprises means for establishing a communication link between said subsurface apparatus and said surface instrumentation.

3. The well bore apparatus of claim 2 wherein said communication link is characterized as bi-directional whereby said subsurface apparatus may receive information signals from said surface instrumentation via said wireline tool and said surface instrumentation may receive information signals from said subsurface apparatus via said wireline tool.

4. The well bore apparatus of claim 1 further comprising:

remote sensing means for generating a signal representative of the operation of said electrical-mechanical means and movement of said latch means, and for transmitting said signal to said surface instrumentation.

5. Well bore apparatus comprising a logging-while-drilling apparatus having a tubular body means for accommodating the lengthwise insertion and removal of a carrier for a nuclear radiation source, said carrier having a fishing head extending upwardly within said body, said logging-while-drilling apparatus having a landing surface secured to said tubular body, said tubular body including means for connecting it in a drilling string, and a wireline tool dimensioned for passage within said drilling string and for landing on said landing surface of said logging-while-drilling apparatus, said wireline tool including a selectively operable electrically powered coupling means for releasably coupling said wireline tool to said fishing head of said carrier, said coupling means including an electrical motor coupled to a latch means for latching said wireline tool said fishing head and pulling said carrier upwardly when powered, thereby releasing said carrier from said tubular body of said logging apparatus.

6. The well bore apparatus of claim 5 further comprising:

means for establishing a communication link between said logging-while-drilling apparatus and said wireline tool.

7. The well bore apparatus of claim 6 wherein said communication link is characterized as bi-directional whereby said logging-while-drilling apparatus may receive information signals from said wireline tool and said wireline tool may receive information signals from said logging-while-drilling apparatus.

8. The well bore apparatus of claim 5 further comprising:

surface instrumentation;

a wireline cable connected between said surface instrumentation and said wireline tool; and remote sensing means disposed on said wireline tool for generating a signal representative of the operation of said motor and for transmitting said signal via said wireline cable to said surface instrumentation.

9. The well bore apparatus of claim 5 wherein said wireline tool includes a tubular housing having an annular landing surface disposed at its bottom end, and wherein said powered coupling means includes an electrical motor and gear reducer coupled together and secured within said tubular housing of said wireline tool and having a threaded output shaft rotatably coupled to latch means including, a shroud threaded about said output shaft said shroud being dimensioned to move axially within said housing with rotation and counter rotation of said output shaft, said shroud adapted to move axially between lower and upper axial positions.

said shroud dimensioned to extend past said fishing head when said landing surface of said wireline tool is landed on said landing surface of said logging apparatus and when said shroud has been moved axially to said lower axial position, and shifting means, including a latching lug adapted to latch onto said fishing head, for forcing said lug to an unlatched radially outward position when said shroud is in said lower axial position and for forcing said latching lug to a radially inwardly latching position when said shroud is moved axially upward.

10. A method for selectively removing a component of a logging-while-drilling tool connected to a drill string while disposed within a well bore, said component being releasably secured within said logging-while-drilling tool and having a fishing head projecting upwardly therefrom, said method comprising the steps of:

a) lowering a wireline tool down through said drill string, said wireline tool including a downwardly-facing, electrically-powered extraction mechanism adapted for selectively latching onto said fishing head of said component of said logging-while-drilling tool, said wireline tool being connected to surface instrumentation with a wireline cable;

b) energizing said extraction mechanism to cause said mechanism to latch onto said fishing head and pull said fishing head upwardly, thereby releasing said component from said logging-while-drilling tool; and c) raising said wireline tool and latched component to the surface.

11. The method of claim 10 wherein said logging-while-drilling tool includes a first communication coil and wherein said wireline tool includes a second communication coil, and further comprising the step of nesting said first and second communication coils within one another and thereby establishing a communication link between said surface instrumentation and said logging-while-drilling tool.

12. Well bore apparatus comprising a logging-while-drilling apparatus having a tubular body means for accommodating the lengthwise insertion and removal of a carrier for a nuclear radiation source, said carrier having a fishing head extending upwardly within said body, said logging-while-drilling apparatus having a landing surface secured to said tubular body, said tubular body including means for connecting it in a drilling string, and a wireline tool dimensioned for passage within said drilling string and for landing on said landing surface of said logging-while-drilling apparatus, said wireline tool including a selectively operable electrically powered coupling means for releasably coupling said wireline tool to said fishing head of said carrier, said coupling means including an electrical motor coupled to a latch means for latching said wireline tool said fishing head;

surface instrumentation;

a wireline cable connected between said surface instrumentation and said wireline tool; and remote sensing means disposed on said wireline tool for generating a signal representative of the operation of said motor and for transmitting said signal via said wireline cable to said surface instrumentation.

13. Well bore apparatus comprising a logging-while-drilling apparatus having a tubular body means for housing electrical instrumentation, said tubular body including means for connecting it in a drill string, said logging-while-drilling apparatus including an annular upwardly-facing landing surface structure coaxially secured within said tubular body, said logging-while-drilling apparatus further including an internal sleeve structure secured within said tubular body, said internal sleeve structure including a first induction coil disposed a first axial distance above said annular landing surface structure, a wireline tool designed and dimensioned for passage within a drilling string and said internal sleeve structure, said wireline tool including a structure having an annular downwardly-facing surface cooperatively designed and arranged to connect said upwardly-facing landing surface of said logging-while-drilling apparatus, said wireline tool further including a second induction coil disposed a second axial distance above said downwardly facing structure so that when said downwardly facing structure of said wireline tool is landed on said upwardly facing landing surface of said logging-while-drilling apparatus, said second induction coil is approximately axially aligned with said first induction coil, and wherein said logging-while-drilling apparatus includes a carrier for a radiation source, said upwardly-facing surface structure is disposed on structure means for securing said carrier within said tubular body of said logging-while-drilling apparatus, said carrier includes an upwardly extending fishing head, said wireline tool includes a selectively operable electrically powered coupling means for releasably coupling said wireline tool to said fishing head of said carrier, and said coupling means includes an electrical motor coupled to a latch means for latching said wireline tool to said fishing head and pulling said carrier upwardly when powered, thereby releasing said carrier from said tubular body of said logging apparatus.

14. The apparatus of claim 13 wherein said first and second axial distances are approximately the same.

* * * * *